US010902704B1

(12) United States Patent
Shoemaker, Jr.

(10) Patent No.: US 10,902,704 B1
(45) **Date of Patent: *Jan. 26, 2021**

(54) CRANE GAME WITH TUBULAR TARGET HOLDERS

(71) Applicant: Stephen P. Shoemaker, Jr., Redondo Beach, CA (US)

(72) Inventor: Stephen P. Shoemaker, Jr., Redondo Beach, CA (US)

(73) Assignee: Stephen P. Shoemaker Trust, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/998,726

(22) Filed: Aug. 20, 2020

(51) Int. Cl.
*A63F 9/30* (2006.01)
*G07F 17/32* (2006.01)

(52) U.S. Cl.
CPC ..... *G07F 17/3297* (2013.01); *A63F 9/30* (2013.01); *G07F 17/3216* (2013.01); *A63F 2250/144* (2013.01)

(58) Field of Classification Search
CPC .. A63F 9/30; A63F 9/0079; A63F 2009/0081; A63F 2250/144; G07F 17/3297; G07F 17/3216; G07F 11/165
See application file for complete search history.

(56) References Cited

U.S. PATENT DOCUMENTS 5,553,859 A * 9/1996 Kelly ..... A63B 67/02 273/338
8,070,167 B1 * 12/2011 Shoemaker, Jr. ..... A63F 9/30 273/447
8,448,948 B1 * 5/2013 Shoemaker, Jr. ..... A63F 9/30 273/447
9,526,978 B1 * 12/2016 Shoemaker, Jr. ... G07F 17/3246
9,539,496 B1 * 1/2017 Shoemaker, Jr. ..... A63F 9/30
9,818,265 B1 * 11/2017 Shoemaker, Jr. ..... H04N 5/232939
10,109,159 B1 * 10/2018 Shoemaker, Jr. ..... A63F 9/30
2002/0067002 A1 * 6/2002 Yoshida ..... A63F 9/30 273/447
2009/0152366 A1 * 6/2009 Anderson, II ..... G07F 7/08 235/493
2013/0214491 A1 * 8/2013 Shoemaker, Jr. ..... F41J 5/24 273/348
2016/0375356 A1 * 12/2016 Shoemaker, Jr. ... G07F 17/3297 273/447
2016/0375357 A1 * 12/2016 Shoemaker, Jr. ... G07F 17/3251 463/7
2016/0375358 A1 * 12/2016 Shoemaker, Jr. ... G07F 17/3297 273/447
2016/0379450 A1 * 12/2016 Shoemaker, Jr. ..... A63F 9/30 273/447
2018/0028905 A1 * 2/2018 Shoemaker, Jr. ..... A63F 9/30
2020/0289918 A1 * 9/2020 Shoemaker, Jr. ..... A63F 9/0079

* cited by examiner

*Primary Examiner* — Raleigh W Chiu
(74) *Attorney, Agent, or Firm* — Fulwider Patton LLP

(57) ABSTRACT

The present invention is directed to an arcade type crane game that includes a target support structure with cylindrical, open ended target holders to prevent targets from toppling before, during, and after playing the game. Here, cylindrical is used in its broadest sense to mean a regular upright structure that supports a target that is round, square, oval, rectangular, etc., and not limited to circular cross sections. The cylindrical holders allow the targets to be lifted upward out of the holder without resistance, but prevents targets from tipping over and knocking other targets over in the process.

3 Claims, 5 Drawing Sheets

FIG. 3
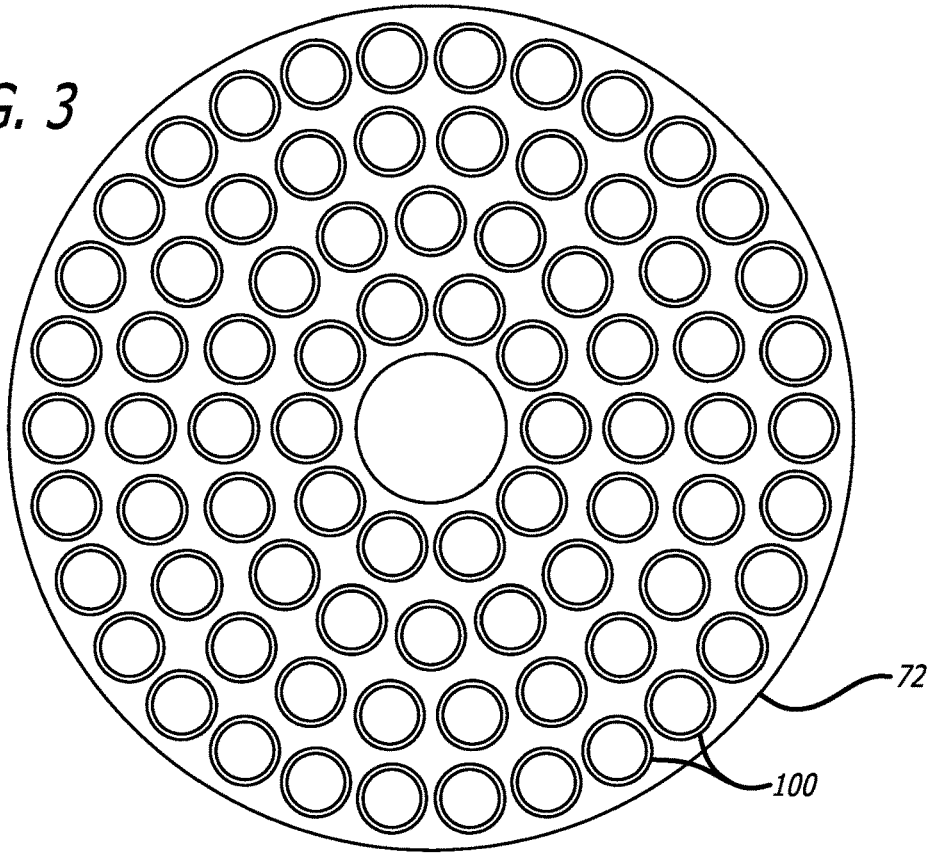
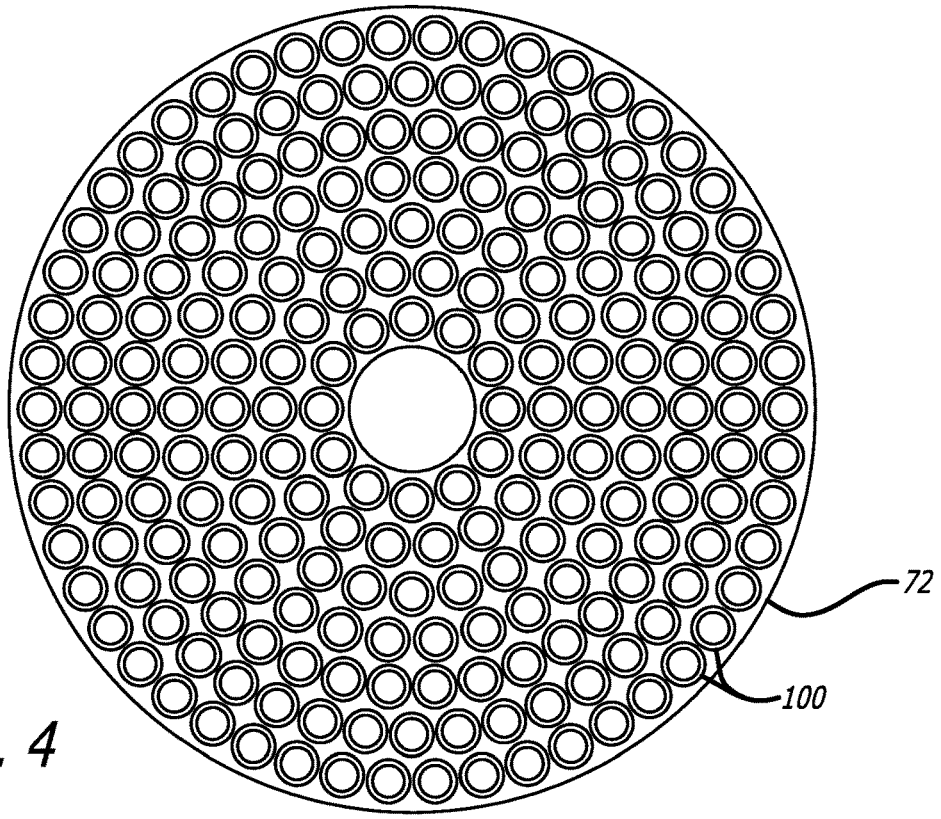
FIG. 4

CRANE GAME WITH TUBULAR TARGET HOLDERS

BACKGROUND

This invention relates generally to arcade games with a crane mechanism, and more particularly to a crane game with a feature to prevent targets from tipping over due to contact with the pick-up device or other factors.

Arcade games are well known in the art, and particularly crane-type games where players maneuver a crane over targets in an attempt to extract the target from a playing field. The targets for claw-type arcade games have traditionally been plush toys. However, the allure of plush toys, while popular with some, is not always an attraction for all players, particularly teens and young adults. Unfortunately, prizes that would be attractive to these players are not readily compatible with claw mechanisms. Thus, a large population of would-be players is lost due to the discrepancy between the types of prizes players want and a game that can work with such prizes that cannot be picked up with a claw type grasp. Aluminum cans are one such target.

The present invention is an arcade game with a crane mechanism that uses a suction device to capture and extract smooth prizes such as aluminum cans of beverages, batteries, or other cylindrical or geometric targets. The present invention provides a game that uses these cylindrical or other geometric shapes as targets for a crane game, offering players a choice of different prizes to try and capture. In the present invention, the targets are limited to those with a smooth, relatively flat upper surface so that a suction cup may be lowered as part of the crane mechanism and attach to the smooth upper surface for extraction from the playing field.

The arcade game may use a rotating playing field where the targets sit on a turntable type rotating disk, or the targets may be arranged on a stationary playing field. In the former case, the pick-up device may move linearly across the turn-table as the targets pass below the crane, and in the latter case the pick-up device preferably moves in both a left to right and back to front directions to cover the entire playing field and therefore each of the targets. The pick-up device can use a joystick, buttons, or other type of player controls to maneuver the pick-up device over the intended target, and then lowered onto an inverted can in an attempt to extract the target from the playing field. The cans are inverted, i.e. placed upside down, because the lower surface of the can is round, smooth, flat, consistently sized, and make a perfect target for the suction cup. The pick-up device preferably uses a suction cup that, if positioned directly over the upper surface of the target, will make a seal with the upper surface and allow the target to be lifted from the playing field. If the suction cup is not placed directly over the target such that a seal is not established, the pick-up device will not be able to apply a fully negative pressure between the target's upper surface and the pick-up device, and the attempt will fail. In the event of a successful attempt, the target is lifted and moved to a retrieval bin adjacent the playing field where the player can obtain the prize. When the play is finished, the pick-up device returns to a parked position ready for the next play.

One issue with the present invention is that targets are relatively spaced close together. When attempting to extract a target, the crane may accidentally knock over other targets, creating a domino effect. This can occur when a target bumps into another target, falls during extraction, swings outward while suspended from the crane, etc., or the game can shift due to various factors (earthquake, mischief, etc.). There is no current method for securing the targets in a crane type arcade game while another target is being extracted from the game.

SUMMARY OF THE INVENTION

The present invention is directed to a crane game that includes a target support structure with cylindrical, open ended target holders to prevent targets from toppling before, during, and after playing the game. Here, cylindrical is used in its broadest sense to mean a regular upright structure that supports a target that is round, square, oval, rectangular, etc., and not limited to circular cross sections. The cylindrical holders allow the targets to be lifted upward without resistance, but prevents targets from tipping over and knocking other targets over in the process like bowling pins. The support structure can be have holders with solid walls or broken walls, as long as the targets are sufficiently supported in all lateral directions so as to be prevented from tipping over when incurring contact from the pick up device, other targets, or outside forces on the game.

These and other benefits of the present invention will best be understood with reference to the detailed description of the invention below, along with the accompanying drawings.

BRIEF DESCRIPTION OF THE DRAWINGS

FIG. 3 is a top view of a first embodiment of the invention;

FIG. 4 is a top view of a second embodiment of the invention;

DETAILED DESCRIPTION OF THE PREFERRED EMBODIMENTS

Figure 1:
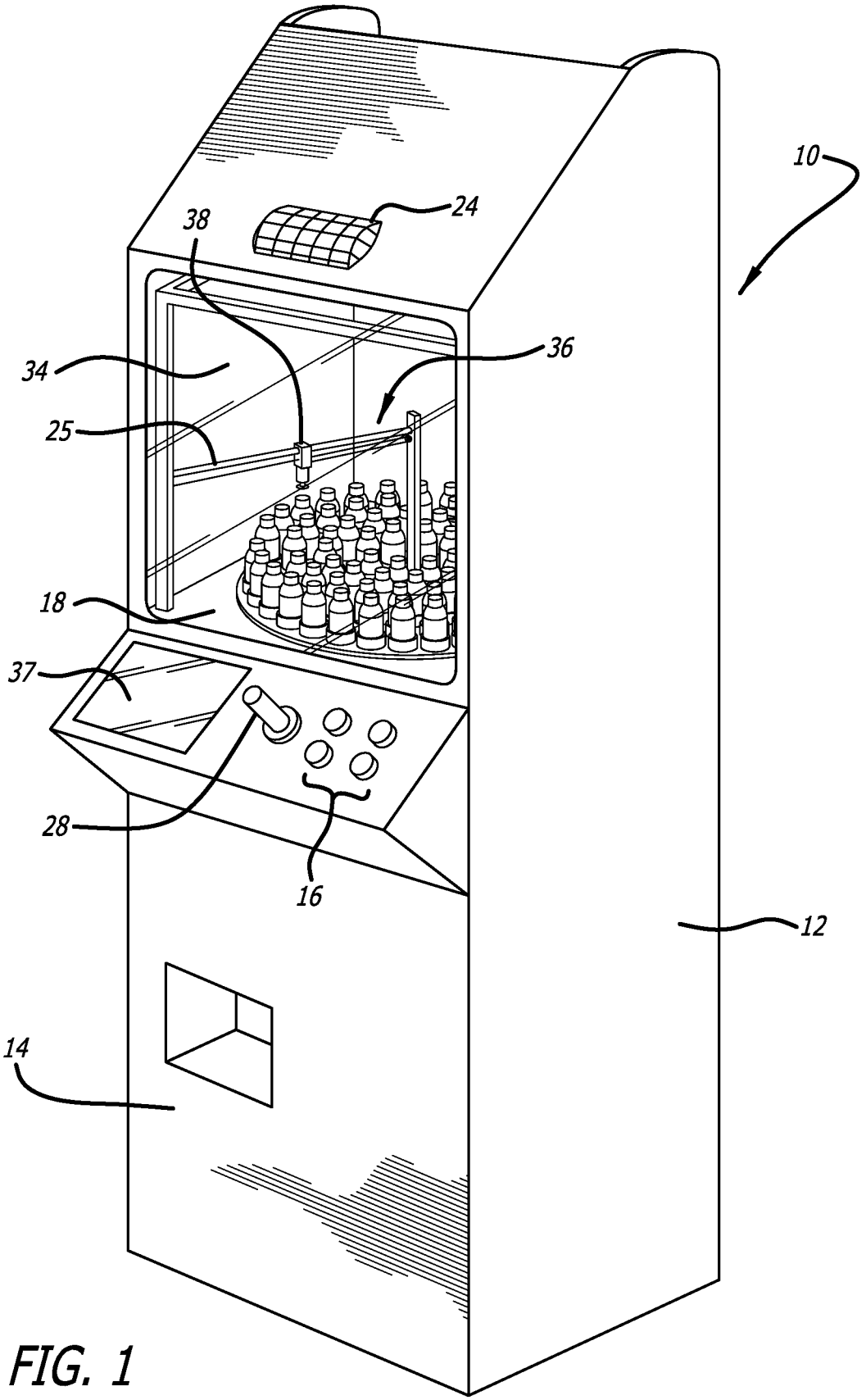
FIG. 1 is an elevated, perspective view of a first embodiment of the present invention.

The type of crane game that serves as the environment for the present invention is disclosed in U.S. patent application Ser. No. 16/352,532 by the present inventor, the content of which is incorporated by reference herein in its entirety. FIG. 1 illustrates a vacuum type crane game found in arcades, boardwalks, and other locations where coin operated games are played. The vacuum pick-up device is similar to the device disclosed in the present inventor's U.S. Pat. No. 5,855,374 entitled Crane Game Including Vacuum And Rotary Table, the content of which is also fully incorporated herein by reference. Depicted is the game apparatus 10 which includes a housing 12, front panel 14, player controls 16, and a playing area 18.

Housing 12 provides a support for the other components of the game apparatus. Housings can take a wide variety of forms; for example, as shown in FIG. 1, housing 12 may be of the stand-up arcade game variety in which a player stands in front of the game or sits on a stool when playing the game. In other embodiments, other types of housings may be provided. For example, a counter-top housing, including approximately the upper half of housing 12 shown in FIG.

1, can be used when the game apparatus is desired to be placed on a table, counter top or other similar surface.

Front panel 14 can be positioned below and/or above the player controls 16 and playing field 18, as shown in FIG. 1. The front panel can also be positioned in a wide variety of other locations on housing 12.

A pick-up device is used to both capture the targets in the playing field and to deliver any successfully captured prizes from playing area 18 to a player-accessible retrieval bin where the player retrieves the prize. With carbonated beverages, transfer of the prize may need to extend all the way to the floor of the retrieval bin so as not to agitate the beverage and cause it to spray out when opened. Speaker(s) 24 emits sounds based on game actions and other game states and is controlled by a game control system.

Player controls 16 allow a player to manipulate events in the game, and typically include a joystick, buttons, switch, knob, or the like. Game action occurs in playing area 18, where a pick up mechanism may be controlled and guided by the player to pick up prize objects, as described below. In the embodiment of FIG. 1, a joystick 28 or similar device (knob, two buttons, etc.) can be manipulated by the player to move the pick-up device in a linear direction (forward and backwards) along a fixed support beam 25. Buttons can also be provided to select various game functions, such as additional velocity control of the pick-up device, number of players in a game, a start button to begin the game, etc. For example, in the described embodiment, a stop or slow button can be pressed by the player to slow down (or stop) the rotational movement of a prize turntable so as to allow the player to more accurately position the pick-up device. In alternate embodiments, the player may be able to control motion of other components of the game, such as horizontal or downward movement of the pick-up device. In some embodiments, a player may get multiple chances to guide the pick-up mechanism with one coin or credit, or, alternatively, the player may be required to insert additional coins.

Game playing area 18 is used to display the game action and prizes to a player and is the area where game action occurs. A transparent shield 34 can prevent the player from interfering with game action. The playing area 18 houses a prize display area 36, a vacuum pick up device 38, and a drive system for moving the pick-up device 38. The pick-up device 38 is a suction cup that is connected to a vacuum where a negative pressure can be created if the suction cup makes a seal with a surface on the target. The player guides the pick-up device 38 horizontally over the playing field, and then either the player of the automatic control of the game lowers the pick-up device 38 over a selected prize in an attempt to capture the prize. If a prize is picked up, the game controller automatically guides the pick-up device 38 with the prize attached to the retrieval bin window 37, which leads to the player's retrieval bin.

Figure 2:
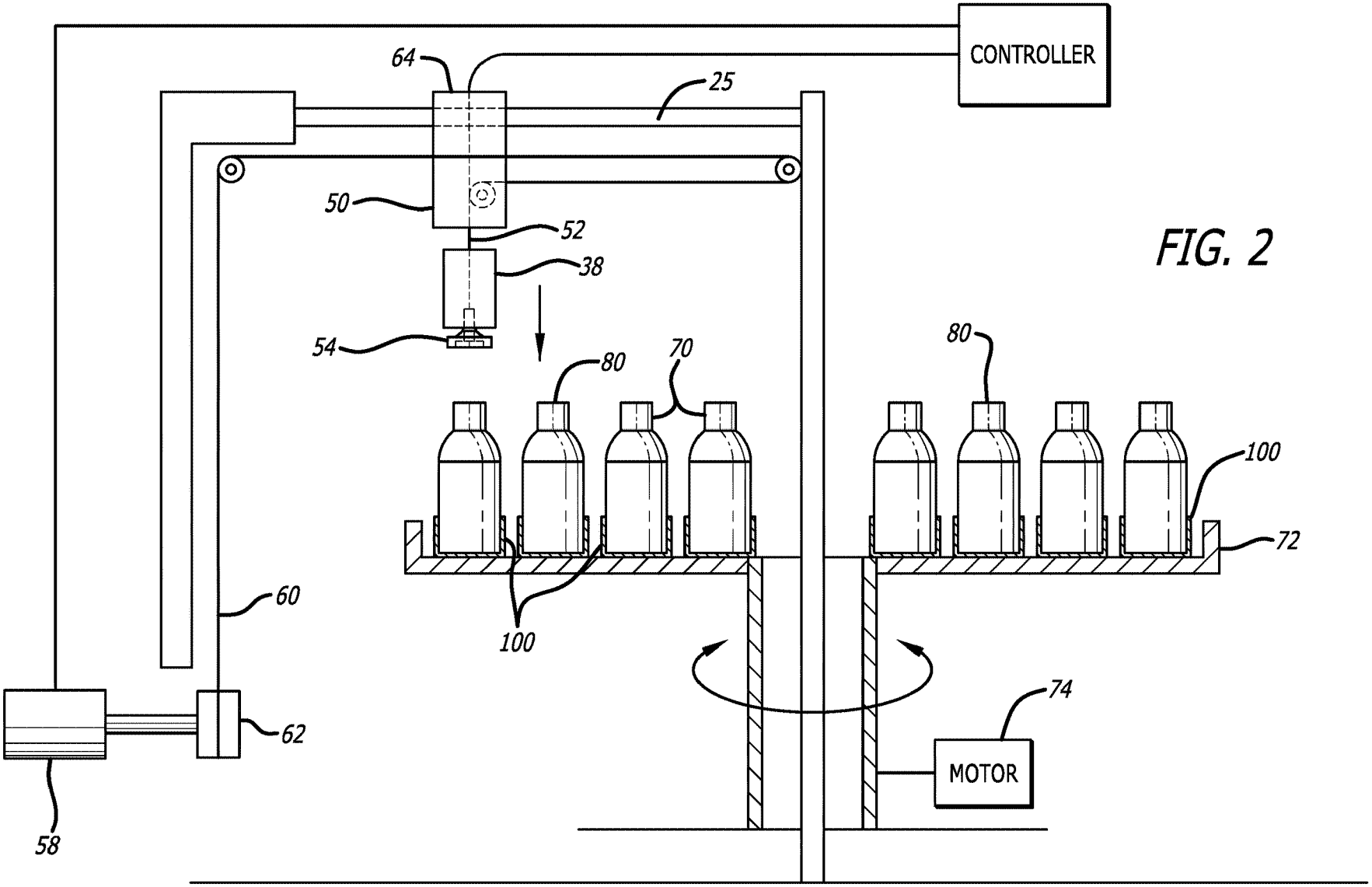
FIG. 2 is a side view, partially in cross section, of the embodiment of the invention of FIG. 1

FIG. 2 illustrates the motion of the pick-up device 38 and the application of the vacuum source to the pick-up device. A vacuum 50 is connected to the pick-up device 38 by tube 52 which communicates a negative pressure to the suction cup 54. Signals from either the player or a motherboard (not shown) are sent to a motor 58 that rotates in two directions and is connected to a cable 60. Cable 60 passes through several pulleys 62 and controls the movement of a carriage 64 mounted on support beam 25. Controlling the motor 58 can move the carriage fore and aft, from the center of the playing field to the outer edge of the turntable 72. As the turntable rotates, the carriage can be located over every spot where targets are disposed, allowing the player to capture any target below. Further details of the pick-up device can be found in the present inventor's U.S. Pat. No. 10,109,159 entitled Arcade Game With Prize Distribution And Collection System And Method, the contents of which are fully incorporated herein by reference.

Figure 5:
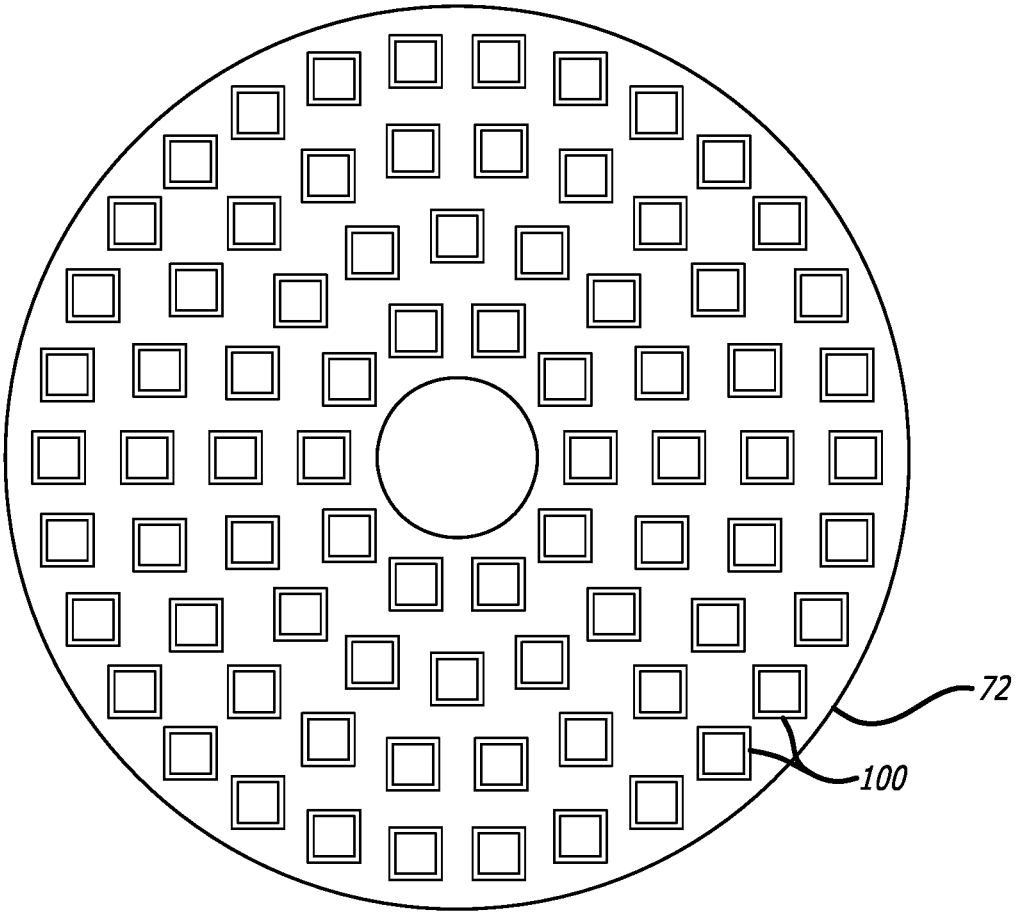
FIG. 5 is a top view of a third embodiment of the present invention.
Figure 7:
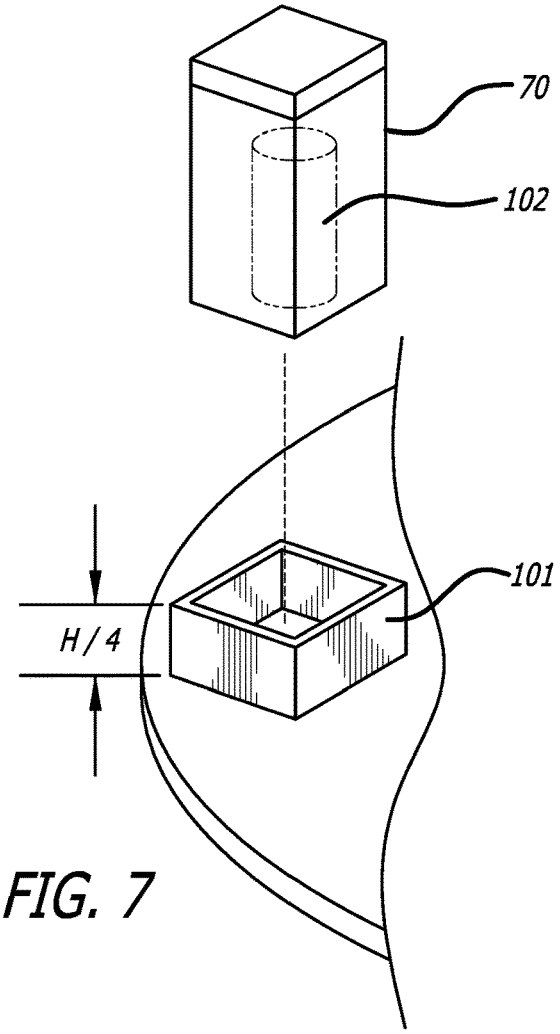
FIG. 7 is an enlarged view, partially in phantom, of a different target and holder.

The carriage 64 supports the pick-up device, and the pick-up device 38 can be raised and lowered from the carriage 64. The targets 70 are shown as beverages in FIG. 2 but may be any prize with a smooth, flat upper surface extending upward from the turntable 72, which in turn is rotated by motor 74. The targets are shown as cylindrical in FIG. 2, but FIGS. 5 and 7 illustrate other variations. The smaller upper surface 80 provides an impediment to successfully capturing the target 70, because if the suction cup 54 does not land completely on the smooth top surface 80, the pick-up device 38 cannot engage the target 70 fully and a negative pressure in the suction cup will be lost. However, if the player successfully maneuvers the pick-up device 38 so that the suction cup 54 does squarely land onto the smooth circular upper surface of the target, then the pick-up device 38 will successfully capture the target and deliver the target to the retrieval bin. The diameter of the suction cup relative to the diameter of the target partially determines the requisite skill needed to successful extract the can. Other factors include the distance between the cup and the can, the speed of the device, and the tolerances of the controls in effecting the outcome of the attempt.

Figure 6:
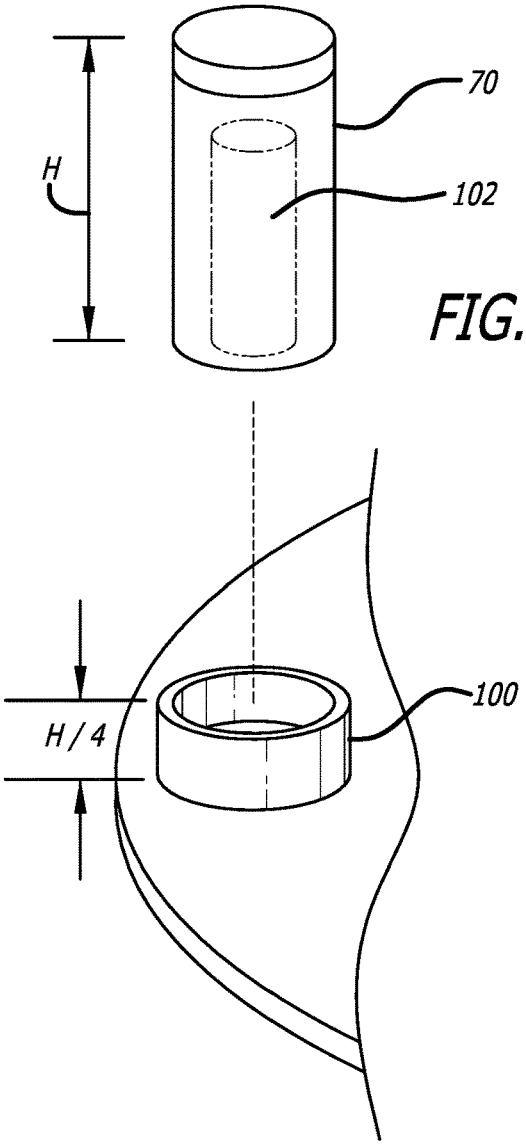
FIG. 6 is an enlarged view, partially in phantom, of a target and holder.

Also shown on the turntable 72 is a plurality of target holders 100 comprising open ended cylindrical structures that receive a target 70 therein and extend to a height of at least one fourth the height H of the target 70 (see FIG. 6). FIGS. 6 and 7 also illustrate that the targets 70, 71 can be containers that house another prize 102 that may not be easily acquired by the vacuum pick up device. In this manner, many different types of prizes can be used while still utilizing the vacuum pick up device as the mode of acquiring the targets 70, 71. FIGS. 3-5 illustrate the various sizes and shapes that can be utilized for the targets and the holders 100 depending on the prize, game difficulty, and other factors.

The use of the target holders having a height of at least one fourth of the target height allows the holders to prevent the targets from tipping over when neighboring targets are extracted. The prize holders also provide a convenient guide for aligning the targets on the rotating playing field, where the holders 100 are fixed to the rotating playing field 72. It should be noted that the holders do not have to have a continuous wall around the target, but rather several partial walls can be enough to prevent target tipping.

A person of ordinary skill in the art will readily recognize that several variations, modifications, and substitutions are possible with the present invention, and the inventor intends to incorporate all such variations, modifications, and substitutions as part of the invention. Accordingly, the invention should not be limited to any particular disclosed or depicted embodiment, but rather the scope of the invention is properly determined by the construction of the appended claims using their ordinary meanings, consistent with but not limited by the descriptions and depictions herein.

I claim:

1. A crane game with a pick-up device, player controls, and a housing surrounding a rotating playing field, comprising:

a plurality of cylindrical targets arranged about the rotating playing field having a circular cross section;

a plurality of target holders on the rotating playing field and each receiving a selected target therein, the target holders having a circular cavity;

the pick-up device comprising a vacuum suction cup;

wherein a height of said cylindrical targets is greater than a height of said target holders; and wherein said targets are characterized by a smooth, upper surface along an entirety of the upper surface.

2. The crane game of claim 1, wherein the targets have a height H, and the target holders have a height of no less than one fourth of H.

3. The crane game of claim 2, wherein the plurality of target holders are affixed to the playing field.

* * * * *